US009655181B2

(12) United States Patent
Gong et al.

(10) Patent No.: US 9,655,181 B2
(45) Date of Patent: May 16, 2017

(54) UNIVERSAL INPUT AND WIDE OUTPUT FUNCTION FOR LIGHT EMITTING DIODE (LED) DRIVER

(71) Applicant: Infineon Technologies Austria AG, Villach (AT)

(72) Inventors: Xiaowu Gong, Singapore (SG); Kok Kee Lim, Singapore (SG)

(73) Assignee: Infineon Technologies Austria AG, Villach (AT)

( * ) Notice: Subject to any disclaimer, the term of this patent is extended or adjusted under 35 U.S.C. 154(b) by 439 days.

(21) Appl. No.: 14/180,056

(22) Filed: Feb. 13, 2014

(65) Prior Publication Data

US 2015/0230303 A1 Aug. 13, 2015

(51) Int. Cl.
*H05B 33/08* (2006.01)
*H05B 37/02* (2006.01)

(52) U.S. Cl.
CPC ..... *H05B 33/0818* (2013.01); *H05B 33/0815* (2013.01)

(58) Field of Classification Search
CPC ..... H02M 1/08; H02M 3/07; H02M 3/156; H05B 33/08; H05B 33/0815; H05B 33/0884; H05B 33/0824; H05B 33/0818; Y02B 20/346
See application file for complete search history.

(56) References Cited

U.S. PATENT DOCUMENTS 7,489,529 B2 2/2009 Yang
8,253,350 B2 8/2012 Hung et al.
2007/0103137 A1* 5/2007 Yang ..... H02M 3/1563 323/284
2009/0058323 A1* 3/2009 Yang ..... H05B 33/0818 315/307
2015/0029763 A1* 1/2015 Shen ..... H02M 1/44 363/21.18

FOREIGN PATENT DOCUMENTS

CN 101252800 A 8/2008

OTHER PUBLICATIONS

"SSL21081/SSL21083 Compact non-dimmable LED driver IC," NXP Semiconductors Product Data Sheet, Rev. 5 Oct. 11, 2012, 22 pp.
U.S. Appl. No. 13/969,963, by Xiao Wu Gong, filed Aug. 19, 2013, and entitled, "Multi-Function Pin for Light Emitting Diode (LED) Driver". 54 pp.
U.S. Appl. No. 13/970,097, by Xiao Wu Gong, filed Aug. 19, 2013, and entitled, "Multi-Function Pin for Light Emitting Diode (LED) Driver". 57 pp.
Office Action, in the Chinese language, from counterpart Chinese Application No. 201510075789.1, dated Nov. 3, 2016, 6 pp.

* cited by examiner

*Primary Examiner* — Alexander H Taningco
*Assistant Examiner* — Renan Luque
(74) *Attorney, Agent, or Firm* — Shumaker & Sieffert, P.A.

(57) ABSTRACT

Techniques are described for controlling an amount of current flowing through one or more light-emitting-diodes (LEDs), without sensing input and/or output voltage, so that the amount of current flowing through the one or more LEDs is approximately equal to a target current level. The techniques provide for coarse and fine tuning of the amount of time a transistor, through which the current flows, is turned on to control the amount of current flowing through the one or more LEDs.

17 Claims, 4 Drawing Sheets

UNIVERSAL INPUT AND WIDE OUTPUT FUNCTION FOR LIGHT EMITTING DIODE (LED) DRIVER

TECHNICAL FIELD

The disclosure relates to light emitting diode (LED) drivers, and more particularly, to the internal and external circuitry of the LED drivers.

BACKGROUND

Light emitting diodes (LEDs) are connected to LED drivers. The LED drivers can control the illumination of the LEDs by controlling the amount of current that flows through the LEDs. In some cases, changes in the input or output voltage causes the current that flows through the LEDs to deviate from the set current level. Such undesirable changes in the current flowing through the LEDs can cause undesirable illumination changes in the LEDs.

SUMMARY

In general, the techniques described in this disclosure are related to a light emitting diode (LED) driver configured to provide a constant output average current over wide a range of input and output voltage levels and frequencies without needing to sense the input and output voltage. In the techniques described in this disclosure, the LED driver charges a capacitor based on an amount of current that is flowing through one or more LEDs coupled to the LED driver. The LED driver compares the voltage across the capacitor with a threshold voltage to adjust the on-duration of a transistor (i.e., the amount of time the transistor stays on) through which the LED current flows. In this manner, the LED driver controls the average amount of current flowing through the one or more LEDs by controlling the timing of the current flowing through the one or more LEDs. By using a measure of the current flowing through the one or more LEDs, the LED driver is configured to adjust the current flowing through one or more LEDs over a wide input and output voltage range without needing to sense the input and output voltage levels and frequencies.

To allow the LED driver to maintain constant average current through the one or more LEDs, the LED driver may be configured to adjust the transistor on-duration over a wide range of the transistor through which the LED current flows. However, during steady-state, the adjustments to the transistor on-duration may be relatively small. This disclosure describes examples of LED drivers with coarse and fine tuning of the transistor on-duration. With coarse tuning, the LED drivers may adjust the transistor on-duration relatively quickly to achieve approximately the correct current value so as to minimize the deviation of the average output current level. With fine tuning, the LED drivers may adjust the transistor on-duration in smaller increments during steady state or after coarse tuning to more accurately set the current level to the average output current level.

In one example, the disclosure describes a light emitting diode (LED) driver comprising a plurality of capacitors, a fine tuning circuit configured to determine an amplitude of a current source used to charge one or more of the plurality of capacitors to adjust an amount of time a power transistor is turned on by a first step-size, and a coarse tuning circuit configured to determine which capacitors of the plurality of capacitors are to be connected in parallel to adjust the amount of time the power transistor is turned on by a second, larger step-size. In an example, an LED current flows through one or more LEDs and into the LED driver via the power transistor, and the fine tuning circuit and the coarse tuning circuit adjust the amount of time the power transistor is turned on to adjust an amount of the LED current that flows through the one or more LEDs to a target LED current level.

In one example, the disclosure describes a system for illuminating one or more light emitting diodes (LED) comprising one or more LEDs, a power transistor that receives an LED current flowing through the one or more LEDs, and an LED driver that receives the LED current from the power transistor. The LED driver is configured to adjust an amount of time the power transistor is turned on by a first step-size by determining an amplitude of a current source used to charge one or more of a plurality of capacitors, and adjust the amount of time the power transistor is turned on by a second, larger step-size by determining which capacitors of the plurality of capacitors are to be connected in parallel. In an example, the LED driver adjusts the amount of time the power transistor is turned on to adjust an amount of the LED current that flows through the one or more LEDs to a target LED current level.

In one example, the disclosure describes a method for illuminating one or more light emitting diodes (LEDs) comprising determining whether a voltage indicative of an amount of LED current flowing through one or more LEDs is less than a first threshold voltage and greater than a second threshold voltage. The LED current flows through a power transistor. In an example, in response to determining that the voltage is less than the first threshold voltage and greater than the second threshold voltage determining an amplitude of a current source used to charge one or more of a plurality of capacitors, and adjusting an amount of time the power transistor is turned on by a first step-size by charging the one or more of the plurality of capacitors based on the determined amplitude. Also, in an example, in response to determining that the voltage is greater than the first threshold voltage or less than the second threshold voltage determining which capacitors of the plurality of capacitors are to be connected in parallel, and adjusting the amount of time the power transistor is turned on by a second, larger step-size by connecting the determined capacitors in parallel. In an example, adjusting the amount of time the power transistor is turned on causes the amount of the LED current to adjust to a target LED current level.

The details of one or more techniques of the disclosure are set forth in the accompanying drawings and the description below. Other features, objects, and advantages of the disclosure will be apparent from the description and drawings, and from the claims.

DETAILED DESCRIPTION

Figure 1:
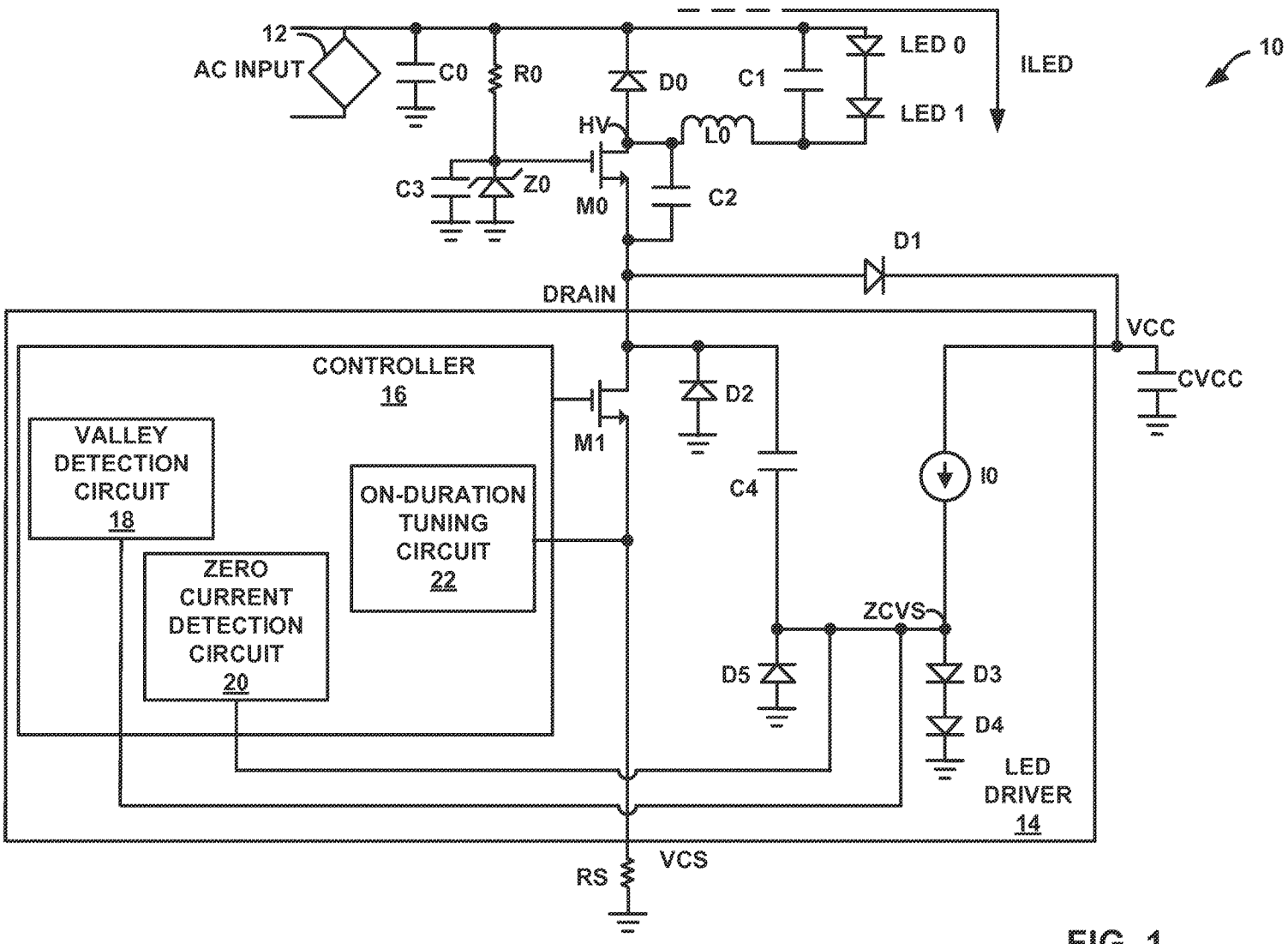
FIG. 1 is a circuit diagram illustrating an example of a light emitting diode (LED) driver system in accordance with one or more examples described in this disclosure.

Light emitting diodes (LEDs) illuminate when current flows through the LEDs. LED drivers control when the current flows through the LEDs and may also control the amount of current that flows through the LEDs so as to control the amount of illumination. The LED drivers utilize space or "real-estate" on the circuit board to which the LED drivers are attached. For example, the LED drivers may be formed as integrated-circuit (IC) chips. The IC chips include a plurality of pins for various types of electrical connections (e.g., power pin, ground pin, drain pin for where the current through the LEDs flows, and possibly other pins).

Although an LED driver can set the average amount of current that flows through the one or more LEDs, changes in the input voltage or output voltage may cause the current level to deviate from the set current level. Some techniques have been proposed to sense the input voltage and/or the output voltage of the LED driver, and adjust the current accordingly so that the average amount of current flowing through the one or more LEDs stabilizes back to the set average current level. However, sensing the input and output voltage requires additional components that increase cost and increase real-estate on the circuit board.

In the techniques described in this disclosure, the LED drivers control the average amount of current flowing through the one or more LEDs without sensing the input and/or output voltage. The LED drivers, as described in this disclosure, may be configured to provide constant output average current regardless of whether the input voltage is high or low, regardless of whether the output voltage is high or low, regardless of whether the input voltage is DC voltage or AC voltage, and regardless of whether the input voltage changes, as a few examples.

As described in more detail below, the LED drivers, described in this disclosure, control the average amount of current flowing through the one or more LEDs by controlling the amount of time the current flows through the one or more LEDs. For example, the one or more LEDs are connected to a source of a power transistor and a drain of the power transistor is connected to an input of the LED driver. The power transistor turns on when the voltage at the source of the power transistor reaches a valley, and the LED driver controls when the power transistor turns off. By controlling the time when the power transistor turns off, the LED driver controls the amount of time the power transistor remains on (referred to as the on-duration of the power transistor). By controlling the on-duration of the power transistor, the LED driver controls the amount of time current flows through the one or more LEDs. By controlling the amount of time current flows through the one or more LEDs, the LED driver controls the average amount of current that flows through the one or more LEDs. For instance, if the current flows through the one or more LEDs for a long time, the average amount of current flowing through the one or more LEDs is greater than if the current flows through the one or more LEDs for a shorter time.

To control the time when the LED driver turns off the power transistor (thereby controlling the on-duration of the power transistor), the LED driver senses a voltage (referred to as VCS) indicative of the current flowing through the one or more LEDs during the turning on period of the power transistor. Circuitry within the LED driver holds the peak voltage of VCS (referred to VCS_INT).

The LED driver may then convert the peak voltage to a current to charge a capacitor. The LED driver compares the voltage across the capacitor to a threshold voltage. If the voltage across the capacitor is greater than the threshold voltage, the current flowing through the one or more LEDs is greater than the target average output current level. In this case, to decrease the average current following through the one or more LEDs to return to the target average output current level, the LED driver reduces the on-duration time of the power transistor for an AC half cycle if the input voltage is an AC voltage or for a pre-determined time if the input voltage is a DC voltage (e.g., 20 milliseconds). If the voltage across the capacitor is less than the threshold voltage, the current flowing through the one or more LEDs is less than the target average output current level. In this case, to increase the average current following through the one or more LEDs to return to the target average output current level, the LED driver increases the on-duration time of the power transistor for an AC half cycle if the input voltage is an AC voltage or for a pre-determined time if the input voltage is a DC voltage (e.g., 20 milliseconds).

A number of factors may cause the LED current to deviate from the target current level. Examples of such factors that can cause the LED current to deviate from the target current level include whether the input voltage is high or low, whether the output voltage is high or low, whether the input voltage is DC or AC, and whether the input voltage will change. In some cases, the deviation in the current may be relatively large. As described above, some other techniques measure the input and output voltage to determine how much to adjust the current flowing through the one or more LEDs, which increase costs and circuit board real-estate. By sensing the current flowing through one or more LEDs to adjust the current flowing through the one or more LEDs, the LED driver may adjust the current to achieve the target current level without needing to sense the input and output voltage.

However, because the current deviation may be relatively large, the LED driver may be configured to adjust the on-duration over a wide range and make the adjustment relatively quickly. Therefore, the LED driver may be configured to implement large step-adjustments to the on-duration so that the current flowing through the one or more LEDs returns back to approximately the target current level relatively quickly. Such large step-adjustments are referred to as coarse tuning in this disclosure. Also, during steady-state, the current deviation may be relatively small. For this case, the LED driver may also be configured to adjust the on-duration over a small range so as to minimize flicker. Therefore, the LED driver may be configured to implement small step-adjustments to the on-duration so that the current flowing through the one or more LEDs returns back to approximately the target current level with minimal flicker. Such small step-adjustments are referred to as fine tuning in this disclosure.

In other words, the LED driver may be configured to determine whether a duration that a power transistor through which an LED current flows needs to be adjusted. In response to determining that the duration that the power transistor through which the LED current flows needs to be adjusted, the LED driver may be configured to adjust the duration that the power transistor through which an LED current flows by at least one of a first step-size (e.g., for coarse tuning) and a second step-size (e.g., for fine tuning), where the first step-size is larger than the second step-size.

In the techniques described in this disclosure, for coarse tuning and fine tuning, the LED driver may utilize a plurality of capacitors connected in parallel with one another. For coarse tuning, the LED driver may control the number of capacitors that are connected to one another in parallel to allow for fast charging or discharging of the capacitors, which allows for large step-size adjustments to the on-duration of the power transistor. For fine tuning, the LED driver may control a current source that charges the capacitors, which allows for small step-size adjustments to the on-duration of the power transistor.

As described in more detail, in some examples, there may be multiple levels of coarse tuning: fast coarse tuning and slow coarse tuning. In this example, the fast coarse tuning may allow for large step-size adjustments, slow coarse tuning may allow for medium step-size adjustments, and fine tuning may allow for small step-size adjustments. Utilizing multiple step-sizes for coarse adjustments is provided for purposes of illustration and should not be considered limiting.

In this way, the techniques allow for adjusting the current flowing through one or more LEDs (LED current) so that the LED current remains on average at approximately the target current level. In the techniques described in this disclosure, the LED driver may not need to sense the input or output voltage for purposes of adjusting the current. Rather, the LED driver is configured to implement coarse and fine tuning of the on-duration when adjustment is needed, as determined by a voltage across a capacitor charged based on the current level.

FIG. 1 is a circuit diagram illustrating an example of a light emitting diode (LED) driver system in accordance with one or more examples described in this disclosure. For example, FIG. 1 illustrates LED driver system 10 which includes LED driver 14 and LED 0 and LED 1, where LED 0 and LED 1 are connected in series. Examples of LED driver system 10 include a circuit board with the illustrated components and LED driver 14, and plug for plugging into a power source, such as an AC input source. However, LED driver system 10 should not be considered limited to such examples.

Although LED driver system 10 is illustrated as including two LEDs (i.e., LED 0 and LED 1), the techniques described in this disclosure are not so limited. In some examples, LED driver system 10 may include one LED, and in some examples, LED driver system 10 may include more than two LEDs. In examples where LED driver system 10 includes two or more LEDs, the LEDs may be connected together in series, in parallel, or some combination of series and parallel connection. In general, LED driver system 10 includes one or more LEDs.

The one or more LEDs of LED driver system 10 illuminate when current flows through them. For example, FIG. 1 illustrates ILED flowing through LEDs 0 and 1. ILED is also referred to as the LED current. ILED originates from the AC input, which may comprise an alternating-current (AC) voltage. Rectifier 12 rectifies the AC voltage, and capacitor C0 low-pass filters the rectified AC voltage to convert the AC voltage to a direct-current (DC) voltage. In some examples, the AC input may be connected to a limiting resistor (not shown) and/or an inductor (not shown) for protection purposes such as protection from short-circuits or fast changes in current.

Although LED driver system 10 is illustrated as being driven by an AC input, the techniques described in this disclosure are not so limited. In some examples, rather than an AC input, LED driver system 10 may be connected to a DC input. In these examples, LED driver system 10 may not include rectifier 12, and may not need to include capacitor C0. However, it may be possible for such a DC voltage driven system to include capacitor C0 to further smooth the DC voltage.

The DC voltage at capacitor C0 causes the ILED current to flow through LEDs 0 and 1, and through inductor L0. The ILED current then flows through external transistor M0. The external transistor M0 may be a power transistor, such as a power metal-oxide-semiconductor field-effect-transistor (MOSFET), a Gallium Nitride (GaN) FET, or other types of transistors. External transistor M0 may also be referred to as a power transistor. In FIG. 1, the LED current (ILED) enters transistor M0 through the drain node of transistor M0, which is labeled as HV. The LED current flows out of the source node of transistor M0, and enters into LED driver 14.

As illustrated in the example of FIG. 1, LED driver 14 includes the DRAIN pin. The DRAIN pin is an input pin of LED driver 14 because the LED current inputs into LED driver 14 via the DRAIN pin (i.e., LED driver 14 receives the ILED current via the DRAIN pin). This input pin of LED driver 14 is labeled as DRAIN because this input pin of LED driver 14 is connected to the drain node of internal transistor M1. Transistor M1 may also be a MOSFET, GaN FET, or other types of transistors, and is referred to as an internal transistor because transistor M1 is internal to LED driver 14. In some examples, transistor M1 may be a low voltage transistor, whereas transistor M0 may be a power transistor.

The LED current flows out of the source node of transistor M1 through the resistor RS connected to the VCS pin of LED driver 14 and to ground, thereby forming a full current path. The value of the resistor RS may define the amplitude of the LED current. In some examples, the resistor RS may be a variable resistor so that the amplitude of the LED current can be modified dynamically (e.g., during operation).

In this way, transistor M0 and transistor M1 together form a switching circuit, with a cascade structure, that allows the LED current to flow through LEDs 0 and 1. For example, if transistor M0 is off, then the LED current will not flow through LEDs 0 and 1, and into LED driver 14, because transistor M0 will function as a high impedance unit that blocks the flow of current. Similarly, if transistor M1 is off, then the LED current will not flow through LEDs 0 and 1, and into LED driver 14, because transistor M1 will function as a high impedance unit that blocks the flow of current.

The DRAIN pin (referred to as an input pin) is a multi-function pin. The term "multi-function" means that LED driver 14 is configured to implement multiple different types of functions using this same input pin. In some examples, this input pin (i.e., the DRAIN pin illustrated in FIG. 1) may be referred to as a "single input multi-function pin." The phrase "single input multi-function pin" means that it may be possible to utilize only this input pin to implement the various different functions. Utilizing only this input pin to implement the various different functions means that circuitry external to LED driver 14 that is connected to LEDs 0 and 1 and not connected to LEDs 0 and 1 through LED driver 14 may need to be connected only to this "single input multi-function pin" (i.e., the DRAIN pin illustrated in FIG. 1) of LED driver 14.

As illustrated, LED driver 14 includes controller 16. Controller 16 is illustrated as a general component that controls the gate node of transistor M1. For instance, controller 16 may cause transistor M1 to turn on by applying a voltage on the gate node of transistor M1 such that the voltage difference between the voltage at the gate of transistor M1 and the source node of transistor M1 is greater than or equal to a threshold turn-on voltage (Vth) (i.e., VGS≥Vth). Controller 16 may cause transistor M1 to turn off by not applying a voltage on the gate node or applying a voltage that is less than the threshold turn-on voltage.

In some examples, controller 16 may be a combination of different distinct components of LED driver 14, such as valley detection circuit 18, zero current detection circuit 20, and on-duration tuning circuit 22 (as described in more detail). In some examples, the components of controller 16 may be formed together. In general, controller 16 is described functionally as one example component that controls when transistor M1 turns on and off. However, the components within controller 16 may individually or together control when transistor M1 turns on and off.

When controller 16 turns on transistor M1, the voltage at the drain node of transistor M1 drops. As illustrated in FIG. 1, the drain node of transistor M1 is the same as the DRAIN pin of LED driver 14 (i.e., the single input multi-function pin of LED driver 14). The drain node is connected to the source node of external transistor M0 (i.e., the source node of transistor M0 is also connected to the single input multi-function pin of LED driver 14). Accordingly, when the voltage at the drain node of transistor M1 drops, the voltage at the source node of transistor M0 also drops.

This drop in the voltage at the source node of transistor M0 causes transistor M0 to turn on. For example, the gate node of transistor M0 is connected to zener diode Z0. The breakdown voltage of zener diode Z0, at room temperature, may be approximately 12 volts (V), as one illustrative example. In this example, zener diode Z0 may limit the voltage at the gate node of transistor M0 to remain at approximately 12 V. With the drop in the voltage at the source node of transistor M0 (which is the same as the drain node of transistor M1), the difference in the voltage at the gate node of transistor M0 and the source node of transistor M0 is larger than the threshold turn-on voltage, and transistor M0 turns on.

Accordingly, when transistor M1 turns on, transistor M0 turns on. When both transistors M0 and M1 are on, the current ILED can flow through LEDs 0 and 1, thereby illuminating LEDs 0 and 1, through transistor M0 and into LED driver 14 via the single input multi-function pin (i.e., the DRAIN pin of LED driver 14). Once into LED driver 14, the ILED current flows through transistor M1 out of the VCS pin and through resistor RS to ground, which forms a complete circuit.

When controller 16 turns off transistor M1 (e.g., by not applying voltage at the gate node of transistor M1 or applying a voltage at the gate node of transistor M1 that is less than the sum of the voltage at the source node of transistor M1 and the threshold voltage), the voltage at the drain node of transistor M1 floats high. In this case (i.e., when transistor M1 is off), the voltage at the drain node of transistor M1 may float high enough that the voltage at the source node of transistor M0 rises to a point that transistor M0 turns off. For example, the drain node of transistor M1 and the source node of transistor M0 may be connected together at the DRAIN pin (i.e., at the single input multi-function pin). When the voltage of the drain node of transistor M1 rises, the voltage at the source node of transistor M0 may become large enough that the difference in the voltage at the gate node of transistor M0 and the source node of transistor M0 is less than the threshold turn-on voltage level.

In this case, the increase in the voltage at the source node of transistor M0 causes transistor M0 to turn-off. Accordingly, when transistor M1 is off, transistor M0 is also off. When transistors M1 and M0 are off, there is no current path to ground for ILED through LED driver 14.

It should be noted that when transistors M1 and M0 turn off, after being on, the LED current does not immediately drop to zero. In FIG. 1, LEDs 0 and 1, inductor L0, capacitor C1, and diode D0 together form a floating buck topology (although other forms such as a tapped buck or quasi-flyback topology may be possible). It is generally well-understood that current through an inductor cannot change instantaneously. Therefore, when transistors M1 and M0 turn off, after being on, inductor L0 does not allow the LED current to instantaneously drop to zero. Rather, the LED current linearly drops to zero over some time, with the amount of time it takes the LED current to drop to zero to be a function of the values of inductor L0 and capacitor C1. When transistor M1 and M0 are turned off and the LED current is dissipating slowly to zero, the current path for the LED current is a path through inductor L0 and diode D0 to form a complete current path.

In the techniques described in this disclosure, valley detection circuit 18 and zero current detection circuit 20 of controller 16 may be configured to determine when transistor M1 should turn-on, which then causes transistor M0 to turn-on, and allows for the LED current to flow through the DRAIN pin and into LED driver 14. On-duration tuning circuit 22 of controller 16 may determine when transistor M1 should turn-off, which then causes transistor M0 to turn-off, and causes the LED current to linearly drop to zero. In other words, because on-duration tuning circuit 22 determines when transistors M1 and M0 turn off, on-duration tuning circuit 22 determine the amount of time transistor M1 and M0 remain on, which in turn determines the amount of time the LED current flows into LED driver 14.

One of the functions of LED driver 14 is to keep the average LED current at a target current level. For example, the resistance value of RS resistor may define the target current level. In the techniques described in this disclosure, LED driver 14 may turn on and off transistors M0 and M1 to control the amount of current flowing through LEDs 0 and 1 (e.g., control the amount of the LED current). For example, for a higher LED current target level, LED driver 14 may keep power transistor M0 on for a longer duration as compared to the case for a lower LED current target level, for which LED driver 14 may keep power transistor M0 on for a shorter duration. In this way, LED driver 14 controls how long the LED current flows through LEDs 0 and 1, which in turn controls the average amount of current flowing through LEDs 0 and 1 (e.g., controls the average amount of the LED current).

However, while LED driver 14 may set the average amount of LED current to the target current level, the actual amount of the LED current that flows through the one or more LEDs may deviate. There may be various causes for the LED current to deviate from the target current level. As one example, whether the voltage on AC input 12 (i.e., input voltage) is high or low may cause the LED current to deviate. As another example, whether the voltage across the one or more LEDs (i.e., output voltage) is high to low may cause the LED current to deviate. As another example, whether the input voltage is AC voltage or DC voltage may cause the LED current to deviate. As yet another example, fluctuations in the input voltage may cause the LED current to deviate. For instance, some countries such as India, the input AC voltage can exhibit a very high tolerance and may be prone to sudden changes or spikes.

To address the deviation in the LED current, some other techniques have been proposed that sense the input and/or output voltage, and adjust the LED current based on the sensing. For example, U.S. Pat. No. 8,253,350 B2 (referred to as the '350 patent herein) describes an LED driver, and illustrates the LED driver of the '350 patent in FIG. 4 of the '350 patent. The techniques of the '350 patent use resistors 408 and 409 and capacitor 410 (illustrated in FIG. 4 of the '350 patent) to sense the input voltage and regulate output average current. Using such additional components may increase cost as well as increase build of material (BOM) (i.e., increase real-estate on the circuit board that includes LED driver 14). Also, the techniques in the '350 patent do not sense output voltage and do not provide good load regulation.

Another proposed technique is described in datasheet for the SSL21081/SSL21083 LED driver by NXP. For instance, FIG. 3 in the datasheet for the SSL21081/SSL21083 LED driver illustrates the connection of an LED driver with other components for driving one or more LEDs. In this proposed technique, deviations in the input voltage cause large changes in the LED current. For example, FIG. 4 in datasheet for the SSL21081/SSL21083 LED driver illustrates LED current as a function of input voltage, and illustrates that changes in the input voltage cause the average LED current to deviate from the target LED current level. Furthermore, the SSL21081/SSL21083 LED driver may not provide very good load regulation.

In the techniques described in this disclosure, LED driver 14 may be configured to adjust the average LED current (i.e., the current flowing through the one or more LEDs) so that the average LED current is approximately equal to the target LED current level (and in many cases equal to the target LED current level) without sensing the input or output voltage. In this way, the techniques may minimize cost and BOM while providing robust LED current control. For instance, the techniques described in this disclosure provide for constant average LED current with a universal input (e.g., AC input at any frequency or level or DC input at any level) and a wide range of output (e.g., any voltage level across LEDs 0 and 1).

As illustrated in FIG. 1, LED driver 14 may be considered as a 5 pin solution, with the DRAIN pin, VCC pin, VCS pin, and COM pin being needed for controlling the LED current. For example, as described in more detail, LED driver 14 uses the COM pin to determine the average LED current (also referred to as average output current) and regulate the average LED current to the target LED current level. In this way, LED driver 14 may be considered as a closed loop controller for average LED current regulation. Other techniques may be open loop control and the average LED current for these other techniques may not be highly accurate (e.g., may not be as close to the target LED current level as compared to using the techniques described in this disclosure). Also, the number of pins that are used for the solution may be different than 5, in other examples.

The DRAIN pin of LED driver 14 may implement the following functions: switching, charging VCC during start-up and normal switching, valley detection, and sensing the point when the LED current reaches zero amps. The manner in which LED driver 14 implements these example functions is described in more detail in U.S. application Ser. No. 13/969,963 ('963 application herein) and Ser. No. 13/970,097 ('097 application herein), both filed Aug. 19, 2013, the contents of each of which being incorporated herein by reference in their entirety. For example, the '963 and '097 applications describe utilizing valley detection circuit 18, zero current detection circuit 20, diodes D1, D2, D3, D4, and D5, capacitors C2, C4, and CVCC, and current source I0 to implement the example functions of LED driver 14 identified above.

Furthermore, the '963 and '097 applications describe example techniques for when the LED current is turned on. For example, the '963 and '097 applications describe that the linear drop of the ILED current to zero may have an effect on the voltage oscillation at the drain node of the power transistor M0. The techniques in the '963 and '097 applications utilize the occurrence of this oscillation to determine when to turn transistors M1 and M0 back on. The techniques in the '963 and '097 applications may utilize quasi_resonant techniques, in which the techniques turn transistors M1 and M0 back on when oscillation at the drain node of transistor M0 is detected (e.g., when the voltage at the drain node of transistor M0 is at a valley point).

For example, valley detection circuit 18 may be configured to detect the valley on the drain node of the power transistor M0. As illustrated the drain node of the power transistor M0 is referred to as the HV node. Accordingly, LED driver 14 may be configured to turn on transistors M0 and M1 when valley detection circuit 18 determines that there is a voltage valley at the HV node. Zero current detection circuit 20 may be configured to determine the point when the LED current reaches zero amps.

On-duration tuning circuit 22 may be configured to determine when transistors M0 and M1 are to turn off (which in effect is equivalent to on-duration tuning circuit 22 determining the amount of time transistors M0 and M1 remain on). For example, LED driver 14 turns on transistors M0 and M1 at the voltage valley at the HV node, and turns off transistors M0 and M1 at the time determined by on-duration tuning circuit 22. Accordingly, the amount of time that transistors M0 and M1 are on is determined by on-duration tuning circuit 22.

Furthermore, the amount of time transistors M0 and M1 are on is directly correlated with the amount of LED current flowing through LEDs 0 and 1. For example, if on-duration tuning circuit 22 keeps transistors M0 and M1 on for a longer period of time, the LED current level will be greater than if on-duration tuning circuit 22 keeps transistors M0 and M1 on for a shorter period of time. In this way, by determining how long transistors M0 and M1 should remain on (i.e., by determining the time transistors M0 and M1 should be turned off), on-duration tuning circuit 22 controls the average LED current level).

In the techniques described in this disclosure, to adjust the LED current so that the LED current is approximately equal to the target current level, on-duration tuning circuit 22 may determine whether the LED current deviated from the target LED current level. If the LED current deviated from the target LED current level, on-duration tuning circuit 22 may adjust the on-duration of transistors M0 and M1 (i.e., adjust the amount of time transistors M0 and M1 are on by controlling the time when transistors M0 and M1 are turned off).

In some examples, on-duration tuning circuit 22 may determine the on-duration of transistors M0 and M1 per half AC cycle if the input voltage is an AC input or at a set interval if the input voltage is a DC input (e.g., 20 milliseconds). During the half AC cycle or set interval for DC, the on-duration of transistors M0 and M1 is kept constant. During this time, on-duration tuning circuit 22 may determine on-duration of transistors M0 and M1 for the next AC cycle or set interval for DC.

As described above, in some situations, the LED current may deviate substantially from the target LED current level due to any of the example causes identified above or due to other possible causes as well. Accordingly, on-duration tuning circuit 22 may be configured to adjust the on-duration of transistors M0 and M1 over a wide range. As one example, on-duration tuning circuit 22 may be configured to set the on-duration of transistors M0 and M1 from approximately 800 nanoseconds (ns) to 20 microseconds (us).

Moreover, because the LED current may deviate substantially, on-duration tuning circuit 22 may be configured to adjust the on-duration of transistors M0 and M1 in relatively large step-sizes from one AC half cycle or set DC period to the next (e.g., adjust the on-duration by more than 10% and even as much as 50%) so that the LED current quickly reaches back to the target current level. In steady-state there is not much deviation in the LED current, and adjusting the on-duration by 10% during steady-state may cause flicker. Accordingly, on-duration tuning circuit 22 may also be configured to adjust the on-duration of transistors M0 and M1 in relatively small step-sizes from one AC half cycle or set DC period to the next (e.g., adjust the on-duration by approximately 0.1%) to minimize flicker effects.

Therefore, on-duration tuning circuit 22 may be configured to adjust the on-duration using very small steps (e.g., ±0.1%) and very large steps (e.g., ±10 or even ±50%). Designing on-duration tuning circuit 22 for such disparate adjustment step sizes may be complicated. As described in more detail, on-duration tuning circuit 22 utilizes a fractional-n technique to allow for disparate adjustment step sizes.

Figure 2:
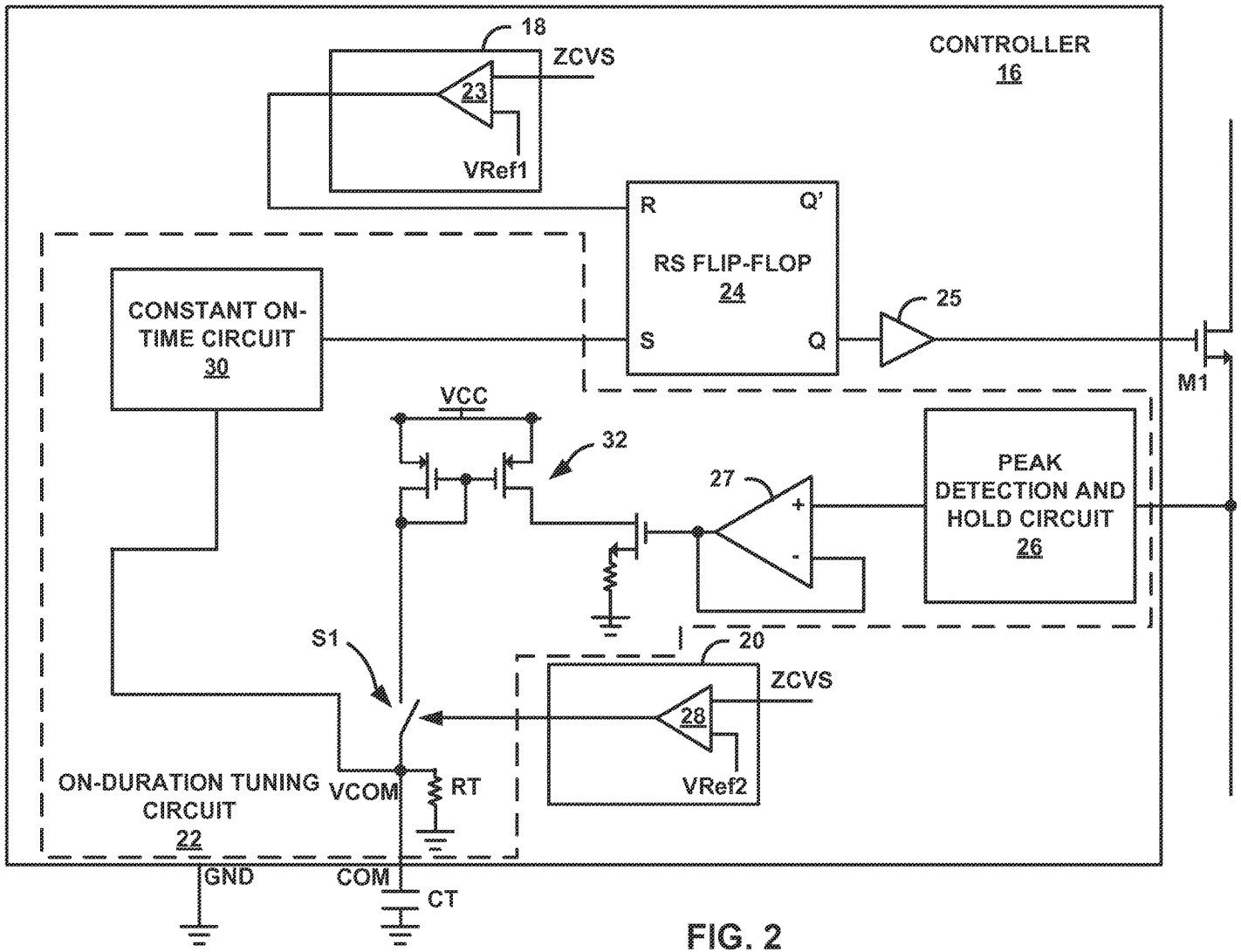
FIG. 2 is a circuit diagram illustrating a controller of the LED driver of FIG. 1 in greater detail.

FIG. 2 is a circuit diagram illustrating a controller of the LED driver of FIG. 1 in greater detail. As illustrated, controller 16 includes valley detection circuit 18 that includes comparator 23, and zero current detection circuit 20 that includes comparator 28. As also illustrated, valley detection circuit 18 and zero current detection circuit 20 each receive the voltage at the ZCVS node (illustrated in FIG. 1) within LED driver 14 as an input.

Based on a comparison between VRef1 and ZCVS with comparator 23, valley detection circuit 18 may determine when the voltage at the HV node (drain node of transistor M0) reached a valley and cause RS flip-flop 24 to output a voltage that causes transistor M1 to turn on, which causes transistor M0 to turn on. Based on a comparison between VRef2 and ZCVS, zero current detection circuit 20 may determine when the LED current reached zero amps, and may close switch S1 allowing for capacitor CT, connected to the COM pin of LED driver 14, to charge. As described in more detail below, the voltage across capacitor CT, referred to as VCOM, may be indicative of the amount of LED current flowing through transistors M0 and M1 (e.g., per AC half cycle or set DC period). In other words, the voltage at the COM pin of LED driver 14, which corresponds to the voltage across capacitor CT, may be indicative of the average amount of current flowing through LEDs 0 and 1 (i.e., the average current level of the LED current).

In some examples, RS flip-flop 24 may be coupled to buffer 25. Buffer 25 may convert the voltage received from the Q node to the appropriate level needed to drive the gate node of transistor M1. Buffer 25 may not be necessary in every example, and may be incorporated as part of RS flip-flop 24.

FIG. 2 also illustrates on-duration tuning circuit 22 within controller 16 in greater detail. As illustrated, on-duration tuning circuit 22 includes peak detection and hold circuit 26, operational amplifier (op-amp) 27, current mirror 32, resistor RT (which may potentially be external to LED driver 14), and constant on-time circuit 30. In some examples, capacitor CT may be considered as being part of on-duration tuning circuit 22, such as in examples where capacitor CT is internal to LED driver 14. In general, on-duration tuning circuit 22 is illustrated conceptually to assist with understanding the techniques described in this disclosure and should not be considered limited to the specific illustrated example.

As described above, valley detection circuit 18 causes controller 16 to turn on transistors M0 and M1 by detecting a valley point of the HV voltage (i.e., voltage valley at the HV node, which is the drain node of transistor M0). On-duration tuning circuit 22 may cause controller 16 to turn off transistors M0 and M1 based on the determined on-duration, which is constant for one AC half cycle or a set period (e.g., 20 ms) if input voltage is DC voltage.

Peak detection and hold circuit 26 receives the voltage at the source node of transistor M1. The voltage at the source node of transistor M1 may be indicative of the current flowing the one or more LEDs, and is referred to as the current sense voltage (VCS). Peak detection and hold circuit 26 may be configured to detect the peak voltage at the source node of transistor M1 and hold that voltage level (VCS_INT), and in some examples, may detect the peak and hold that voltage level during the turning on period of power transistor M0.

As illustrated, peak detection and hold circuit 26 outputs the voltage level (VCS_INT) to operational amplifier (op-amp) 27. Op-amp 27 converts the hold voltage level, outputted by peak detection and hold circuit 26, to a current (ICS_CUR).

The current that op-amp 27 outputs charges capacitor CT when there is current through the LED. For example, zero detection circuit 20 may be have closed switch S1. Also, op-amp 27 outputs to the gate node of a transistor connected to op-amp 27, and when this transistor is turned on, current sinks through current mirror 32 and through the transistor to ground. The sinking of current through the transistor to ground causes a current to flow through switch S1, when closed, and charges capacitor CT.

In some examples, after the LED current reaches an amplitude of zero amps, as determined by zero current detection circuit 20, there may be delay before controller 16 causes transistor M1 to turn on, which in turn causes transistor M0 to turn on. During this delay, zero current detection circuit 20 may cause switch S1 to be open, and no current is used to charge capacitor CT. During other times, such as when the amplitude of the LED current is not at zero amps, zero current detection circuit 20 may cause switch S1 to be closed, and allow capacitor CT to charge.

As illustrated, capacitor CT is coupled to resistor RT. Resistor RT may discharge capacitor CT when switch S1 is open. Accordingly, voltage across capacitor CT, referred to as VCOM, may be representative of the average amount of current flowing through LEDs 0 and 1.

LED driver 14 may utilize the coupling provided by capacitor C2 to detect how long it took for the LED current to drop to zero (i.e., LED current drop period). For instance, during the period when LED current is dropping to zero, the HV voltage is flat, but when the LED current drops to zero, the HV voltage may start to oscillate. In other words, when the HV voltage beings to oscillate is indicative of the LED current dropping to zero. Capacitor C2 couples this oscillation to the DRAIN pin, which is then sensed internal to LED driver 14, and can be used by LED driver 14 for purposes of determining that the LED current dropped to zero.

Constant on-time circuit 30 receives the VCOM voltage and compares the voltage with a plurality of fixed voltage levels (e.g., 1.2V, 1.4V, 1.5V, 1.6V, and 1.8V), where one of the plurality of fixed voltage levels is the middle voltage level (e.g., 1.5V). If the VCOM voltage is greater than the middle voltage level, then the LED current is greater than the target LED current level. In this case, if constant on-time circuit 30 determined that the VCOM voltage is greater than the middle voltage level, constant on-time circuit 30 may decrease the amount of time that transistors M0 and M1 are turned on (i.e., decrease the on-duration of transistors M0 and M1). If the VCOM voltage is less than the middle voltage level, then the LED current is less than the target LED current level. In this case, if constant on-time circuit 30 determined that the VCOM voltage is less than the middle voltage level, constant on-time circuit 30 may increase the amount of time that transistors M0 and M1 are turned on (i.e., increase the on-duration of transistors M0 and M1). Constant on-time circuit 30 may utilize the other voltage levels (i.e., other than the middle voltage level) to determine by how much to increase or decrease the on-duration of transistors M0 and M1.

For example, if the input voltage is an AC voltage, then for the entire next AC half cycle, constant on-time circuit 30 may increase or decrease (as appropriate) the on-duration of transistors M0 and M1. If the input voltage is a DC voltage, then for a set period (e.g., 20 ms), constant on-time circuit 30 may increase or decrease (as appropriate) the on-duration of transistor M0 and M1. Constant on-time circuit 30, in turn, may output a voltage to the set (S) node of RS flip-flop 24 that indicates whether transistor M1 should be on or off.

In other words, constant on-time circuit 30 sets the amount of time that transistor M1 and transistor M0 will be on for half a cycle of the AC input voltage or a set period for the DC input voltage (e.g., 20 ms). For the next half cycle of the AC input voltage or the set period for the DC input voltage, constant on-time circuit 30 may increase the amount of time transistor M1 and transistor M0 stay on or decrease the amount of time transistor M1 and transistor M0 stay on. By controlling the amount of time transistor M1 and M0 stay on, LED driver 14, via on-duration tuning circuit 22, may be able to control the average amount of the LED current. For instance, the voltage across capacitor CT (VCOM voltage) represents the average amount of the LED current, and on-duration tuning circuit 22, via constant on-time circuit 30, controls the average amount of the LED current by modifying the amount of time transistor M1 and M0 stay on, on a per half cycle basis for AC input voltage or a set period for DC input voltage, as one example. Using a per half cycle basis for AC input voltage and 20 ms for the set period of DC input voltage is provided for purposes of illustration and should not be considered limiting.

In accordance with the techniques described in disclosure, on-duration tuning circuit 22, via constant on-time circuit 30, may increase or decrease the amount of time transistors M0 and M1 are turned on (i.e., increase or decrease the on-duration) with coarse tuning and fine tuning. With coarse tuning, constant on-time circuit 30 may adjust the on-duration in relative large step-sizes to quickly converge the LED current to the target current level. With fine tuning, constant on-time circuit 30 may adjust the on-duration in relatively small step-sizes to avoid flicker affects.

Figure 3:
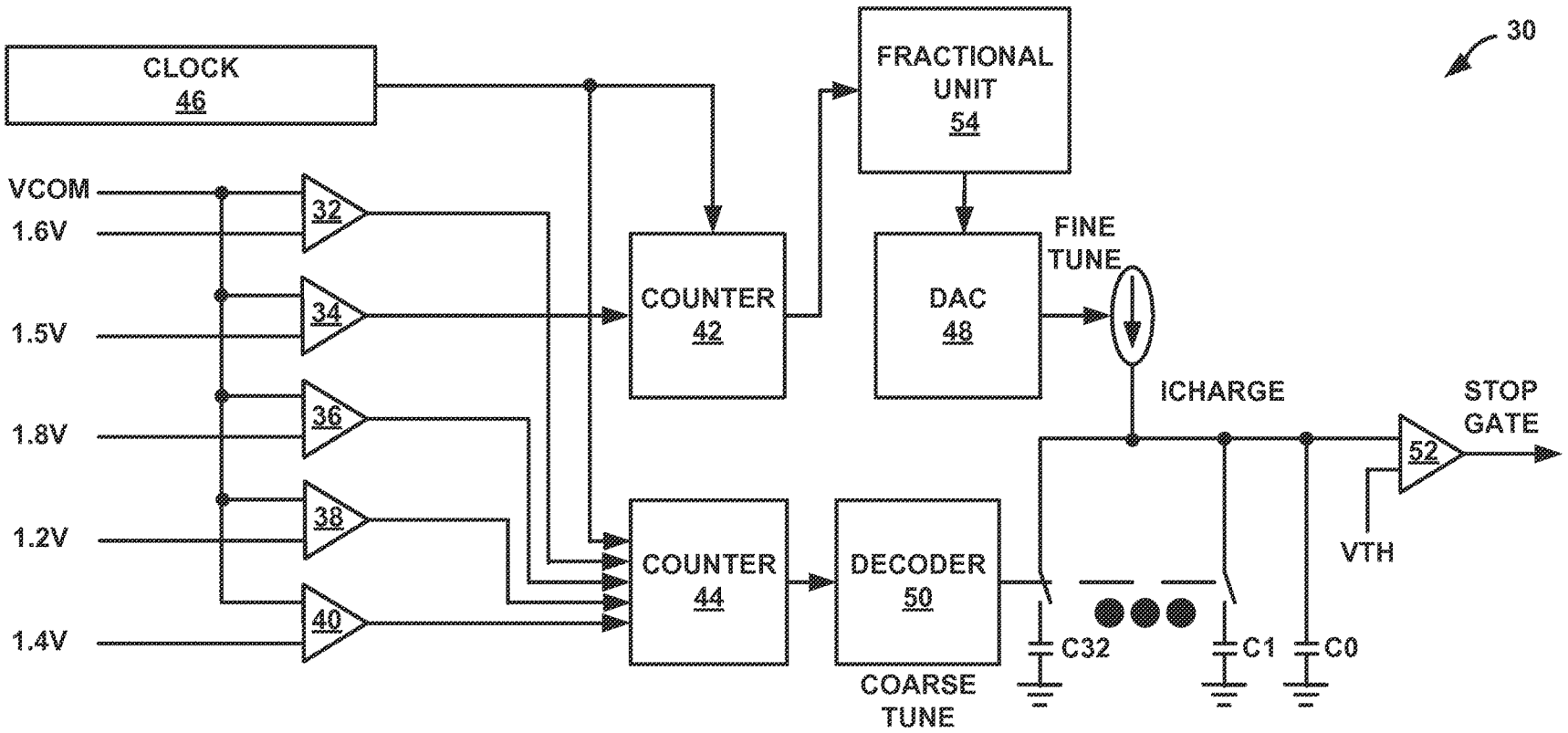
FIG. 3 is a circuit diagram illustrating a constant on-time circuit of the on-duration tuning circuit of FIG. 2 in greater detail.

FIG. 3 is a circuit diagram illustrating a constant on-time circuit of the on-duration tuning circuit of FIG. 2 in greater detail. As illustrated, constant on-time circuit 30 includes comparators 32, 34, 36, 38, and 40 that each compares the VCOM voltage to a fixed voltage level. In the illustrated example, if the VCOM voltage is greater than 1.5 volts (V), then on-duration tuning circuit 22, via constant on-time circuit 30, may decrease the on-duration of transistors M0 and M1, and if the VCOM voltage is less than 1.5V, then on-duration tuning circuit 22, via constant on-time circuit 30, may increase the on-duration of transistors M0 and M1.

For instance, as illustrated, comparator 32 compares VCOM to 1.6V, comparator 34 compares VCOM to 1.5V, comparator 36 compares VCOM to 1.8V, comparator 38 compares VCOM to 1.2V, and comparator 40 compares VCOM to 1.4V. In this example, the voltages of 1.2V, 1.4V, 1.5V, 1.6V, and 1.8V may be considered to be a plurality of fixed voltages to which constant on-time circuit 30 compares the VCOM voltage. Also, the 1.5V fixed voltage is the middle voltage of 1.2V, 1.4V, 1.6V, and 1.8V. It should be understood that voltage values of 1.2V, 1.4V, 1.5V, 1.6V, and 1.8V is provided for purposes of illustration only and should not be considered limiting. Moreover, this example illustrates two voltages below the middle voltage (i.e., 1.2V and 1.4V below 1.5V) and two voltages above the middle voltage (i.e., 1.6V and 1.8V above 1.5V); however, the techniques are not so limited. There may more or fewer than two voltage levels above the middle voltage level. Also, the voltage level used to determine whether the on-duration should be adjusted (e.g., 1.5V in this example) need not necessarily be the middle voltage.

As described above, because the deviation in the LED current may be relatively large, LED driver 14 may be configured to adjust the on-duration of transistors M0 and M1 over a wide range to support universal input and wide output voltage. In some examples, the on-duration of transistors M0 and M1 may range from 800 ns to 20 us. Because of the wide range of the on-duration, constant on-time circuit 30 may be configured to adjust the on-duration in relatively large steps (e.g., at least by 10% per half cycle or set period). To avoid flicker, constant on-time circuit 30 may be configured to adjust the on-duration in relatively small steps (e.g., 0.1%).

However, implementing techniques that allow for such large step-sized adjustments and also allow for such small step-sized adjustments may be complicated and difficult to test. In accordance with the techniques described in this disclosure, on-duration tuning circuit 22, via constant on-time circuit 30, may set the on-duration by interconnecting a plurality of capacitors in parallel and controlling the amplitude of the current that charges the capacitors.

As illustrated in FIG. 3, constant on-time circuit 30 includes capacitors C0-C32. Capacitors C1-C32 are connected to respective switches that connect to the ICHARGE current source. There may be more or fewer than capacitors C1-C32, and these capacitors are illustrated for purposes of example only.

In accordance with the techniques described in this disclosure, by controlling which ones of capacitors C1-C32 are connected together in parallel, constant on-time circuit 30 may provide coarse tuning of the on-duration (e.g., adjust on-duration by relatively large step sizes). By controlling the amplitude of the ICHARGE current, constant on-time circuit 30 may provide fine tuning of the on-duration (e.g., adjust on duration by relatively small step sizes). Initially, the ICHARGE current may charge capacitors C0-C32 such that voltage across these capacitors is approximately equal to the VTH voltage.

To achieve small step-sizes (e.g., in the order of ±0.1%), the techniques may utilize a fractional-n method. In the fractional-n method, constant on-time circuit 30 may keep the on-duration the same as the previous on-duration except once every $N^{th}$ time in the AC half cycle or the set period for DC voltage. For instance, in an AC half cycle or the set period for DC voltage, transistors M0 and M1 may turn on and off multiple types (e.g., 1000 times). Transistors M0 and M1 turning on and off is referred to as a switching pulse.

Constant on-time circuit 30 may group a plurality of switching pulses (i.e., N switching pulses) as one unit, where there are multiple units in an AC half cycle or the set period for DC voltage (e.g., 1000/N). Constant on-time circuit 30 may adjust the on-duration once per unit. For the other switching pulses, constant on-time circuit 30 may keep the on-duration the same as the previous on-duration. In this way, constant on-time circuit 30 may be able to adjust the on-duration for a larger value, but across the entire N switching pulses the adjustment may be smaller.

As an example, to achieve 0.1% change in the on-duration for one AC half cycle or one set period for DC, ideally constant on-time circuit 30 would adjust the on-duration by 0.1% for each switching pulse. However, making such a small adjustment for each switching pulse may be impractical.

It may be practical for constant on-time circuit 30 to make a larger adjustment to the on-duration time than 0.1%. If constant on-time circuit 30 only makes this larger adjustment to the on-duration time once over a unit (where a unit includes N number of switching pulses), then over the entire unit the effective on-duration is much lower.

For instance, constant on-time circuit 30 may set N equal 32, which means that 32 switching pulses are treated as one unit. In this example, constant on-time circuit 30 may adjust the on-duration by 3.2% for one switching pulse of the 32 switching pulses, and keep the on-duration the same as the previous for the other 31 switching pulses. Adjusting the on-duration by 3.2% may be much easier than adjusting the on-duration by 0.1%. Therefore, in this example, the effective adjustment to the on-duration is 0.1% (i.e., 3.2% divided 32) for the one unit of switch cycles. Constant on-time circuit 30 may apply the same techniques for all groups of 32 switching pulses in an AC half cycle or the set period for DC voltage (i.e., apply the same techniques for every 32 switching pulses within all switching pulses that occur in the AC half cycle or the set period for DC voltage).

Accordingly, the effective adjustment to the on-duration for the entire AC half cycle or the set period for DC voltage will be 0.1%. In this way, the fractional-n method adjusts the on-duration for a fraction of switching pulses and keeps the on-duration the same as the previous on-duration for the other switching pules to achieve an effective finer adjustment (i.e., adjust by 3.2% for a fraction of the switching pulses to achieve an effective finer adjustment of 0.1%).

It should be understood that the above example utilized 32 switching pulses as a unit as one example, and constant on-time unit 30 may utilize more or fewer then 32 switching pulses as a unit. Furthermore, the above example also utilized up to 32 capacitors C1-C32 that may potentially be interconnected together. It should be understood that the number of capacitors that can potentially be interconnected and the number of switching pulses that form a unit need not necessarily be the same in every example. For instance, there may more or fewer than 32 capacitors that are selectively connected in parallel and more or fewer than 32 switching pulses in a unit, and these numbers need not be the same.

As illustrated in FIG. 3, to achieve fine tuning, comparator 34 compares the VCOM voltage to 1.5V. Based on the comparison, counter 42 may increment or decrement. Counter 42 may be an up/down counter, and in some examples, a 9-bit up/down counter. Counter 42 may receive a clock from clock 46 that causes counter 42 to increment or decrement. Clock 46 may be 100 Hz clock, which means that counter 42 increments or decrements every 10 ms (1/100 equal 10 ms).

Fractional unit 54 receives the value from counter 42 and is configured to output a voltage used to implemented the fractional-n technique. For example, fractional unit 54 may output a voltage every Nth sample of the unit of switching pulse. Digital-to-analog converter (DAC) 48 receives the value from fractional unit 54 and sets the amplitude of the ICHARGE current source. In this manner, fractional unit 54 may output a voltage that when converted to a digital voltage by DAC 48 causes the ICHARGE current source to set the current level to the same level for N−1 switching pulses within a unit of switching pulses, where there are a plurality of switching pulses within a half cycle for AC input voltage or a set period for DC input voltage. Fractional unit 54 may output a voltage that when converted to a digital voltage by DAC 48 causes the ICHARGE current source to set the current level to the modified level for the Nth switching pulse within the unit of switching pulses. Accordingly, the effective on-duration of the power transistor for a unit of switching pulses can equal the fine tuning adjustment even if the on-duration of the power transistor was different for the Nth switching pulse within the unit of switching pulses.

As an example, keeping with the previous example, assume that 32 switching pulses form a unit. In this example, fractional unit 54 may output a voltage that causes DAC 48 to output a voltage that sets the amplitude of the ICHARGE current source such that the amount of time it takes ICHARGE current source to charge the capacitors C0-C32 that are connected to one another is adjusted by 3.2% for the Nth switching pulse within the unit of switching pulses. For many of the switching pulses, fractional unit 54 causes DAC 48 to set the current level for the ICHARGE current source for N−1 switching pulses of a unit of switching pulses. However, for the $N^{th}$ switching pulse (i.e. once every 32 switching pulses), fractional unit 54 outputs a voltage that causes DAC 48 to output a voltage that causes the ICHARGE current source to output the modified amplitude (e.g., a change by 3.2% for an effective modification of 0.1% in the current, which is an effective adjustment of 0.1% for a unit of switching pulses). In this way, on-duration tuning circuit 22, via constant on-time circuit 30, may be configured to implement fine tuning (i.e., adjust the on-duration of transistors M0 and M1 with small step-sizes).

For example, comparator 34 compares the VCOM voltage to 1.5V. If within one AC half cycle or the set period of DC voltage, the VCOM voltage is higher than 1.5V, counter 42 decrements by 1. After DAC 48, charging current ICHARGE will effectively increase by 0.1%, in accordance with the fractional-n method, and for the next whole AC cycle or set period for DC voltage, the on-duration will effectively decrease by 0.1%. If within one AC half cycle or the set period of DC voltage, the VCOM voltage is lower than 1.5V, counter 42 increments by 1. After DAC 48, charging current ICHARGE will effectively decrease by 0.1%, in accordance with the fractional-n method, and for the next whole AC cycle or set period for DC voltage, the on-duration will effectively increase by 0.1%. In some examples, the fine tuning method should cover ±25% of the on-duration range.

Counter 42, DAC 48, and fractional unit 54 may together be considered as forming a fine tuning circuit. Accordingly, LED driver 14 may comprise a fine tuning circuit configured to determine an amplitude of a current source (e.g., the ICHARGE current source) used to charge one or more of a plurality of capacitors (e.g., C0-C32) to adjust an amount of time a power transistor is turned on (e.g., an on-duration of power transistor M0) by a first step-size (e.g., 0.1%).

It should be understood that the above describes one example way in which to implement the fractional-n technique. However, it may be possible to implement the fractional-n technique utilizing other ways. The techniques described in this disclosure should not be considered limited to the example way of implementing the fractional-n method described above.

In some examples, a comparator is configured to compare a voltage indicative of the amount of LED current flowing through the one or more LEDs to a threshold voltage. For instance, comparator 34 is configured to compare the VCOM voltage, across capacitor CT, which is indicative of the amount of LED current flowing through the one or more LEDs. The fine tuning circuit of LED driver 22 may determine the amplitude of the ICHARGE current source based on the comparison (e.g., by incrementing or decrementing counter 42 and determining the amplitude from the digital-to-analog conversion via DAC 48).

The fine tuning circuit may implement the fractional-n method for adjusting the on-duration of power transistor M0 by the first step-size. For example, the fine tuning circuit may cause the ICHARGE current source to output current at the amplitude determined by the fine tuning circuit for one switching pulse with a unit of switching pulses (e.g., 32 switching pulses within a unit of switch pulse) to adjust the amount of time the power transistor is turned on by a larger step size (e.g., by 3.2% rather than 0.1%).

In the techniques described in this disclosure, a switching pulse is one instance of the LED current turning on and off, and there are one or more units of switching pulses in a half cycle of an AC input voltage or a set period of a DC input voltage. For instance, a unit of switching pulse may be 32 switching pulses, and within a half cycle of an AC input voltage or a set period (e.g., 20 ms) of a DC input voltage there may be 1000/32 units of switching pulses, which means that there are 1000 switching pulses within a half cycle of an AC input voltage or a set period of a DC input voltage.

In the techniques described in this disclosure, the fine tuning circuit may cause the ICHARGE current source to output current at the amplitude determined by the fine tuning circuit for one switching pulse within the unit of switching pulses and output current at the previous amplitude for the remaining switching pulses. In this manner, the fine tuning circuit causes an effective adjustment to the amount of time the power transistor is turned on by the first step-size for the half cycle of the AC input voltage or the set period of the DC input voltage. For example, if a unit of switching pulses includes 32 switching pulses and the ICHARGE current cause the on-duration to adjust by 3.2%, the fine tuning circuit causes an effective adjustment to the on-duration of power transistor M0 by 3.2%/32, which is 0.1%.

To implement coarse tuning, on-constant circuit 30 may selectively connect one or more capacitors C0-C32 together in parallel to configure the overall capacitance. For instance, the amount of time it takes the ICHARGE current source to charge capacitors C0-C32 may be a function of how many and which ones of these capacitors are connected together in parallel. In the techniques described in this disclosure, decoder 50 may store a look-up table that indicates which ones of capacitors C0-C32 should be connected together in parallel based on the value from counter 44.

Even with coarse tuning, in some examples, there may be fast coarse tuning and slow coarse tuning. The step-size in adjusting the on-duration for the fast coarse tuning is greater than the step-size in adjusting the on-duration for the slow coarse tuning. Utilizing fast coarse tuning and slow coarse tuning may not be necessary in every example, and only one level of coarse tuning may be sufficient. Alternatively, in some examples, there may be multiple levels of coarse tuning (i.e., in addition to slow and fast coarse tuning). In some examples, the coarse tuning should cover the whole on-duration range of 800 ns to 20 us.

For slow coarse tuning, comparator 32 compares the VCOM voltage to 1.6V and comparator 40 compares the VCOM voltage to 1.4V. If within one AC half cycle or the set period for DC voltage, the VCOM voltage is higher than 1.6V, then counter 44 decrements by 1. Counter 44 may also be an up/down counter and may be a 6-bit up/down counter, as one example. Decoder 50 may determine which capacitors C0-C32 should be connected together based on the value from counter 44. In this example, decoder 50 may determine which capacitors C0-C32 should be connected together so that the overall capacitance will decrease by 10%. In this case, for the next whole AC half cycle or set period for DC voltage, the on-duration will decrease by 10%.

If within one AC half cycle or the set period for DC voltage, the VCOM voltage is lower than 1.4V, then counter 44 increments by 1. Decoder 50 may determine which capacitors C0-C32 should be connected together based on the value from counter 44. In this example, decoder 50 may determine which capacitors C0-C32 should be connected together so that the overall capacitance will increase by 10%. In this case, for the next whole AC half cycle or set period for DC voltage, the on-duration will increase by 10%.

If within one AC half cycle or the set period for DC voltage, the VCOM voltage is higher than 1.4V and less than 1.6V, counter 44 may not increment or decrement. In this case, the overall capacitance will remain the same. For the next AC half cycle or the set period for DC voltage, the on-duration may not change too much, and may only be affected by the fine tuning.

For fast coarse tuning, comparator 36 compares the VCOM voltage to 1.8V and comparator 38 compares the VCOM voltage to 1.2V. If within one AC half cycle or the set period for DC voltage, the VCOM voltage is higher than 1.8V, then counter 44 decrements by 5. Decoder 50 may determine which capacitors C0-C32 should be connected together based on the value from counter 44. In this example, decoder 50 may determine which capacitors C0-C32 should be connected together so that the overall capacitance will decrease by 50%. In this case, for the next whole AC half cycle or set period for DC voltage, the on-duration will decrease by 50%.

If within one AC half cycle or the set period for DC voltage, the VCOM voltage is lower than 1.2V, then counter 44 increments by 5. Decoder 50 may determine which capacitors C0-C32 should be connected together based on the value from counter 44. In this example, decoder 50 may determine which capacitors C0-C32 should be connected together so that the overall capacitance will increase by 50%. In this case, for the next whole AC half cycle or set period for DC voltage, the on-duration will increase by 50%.

In this example, counter 44 and decoder 50 may be considered as forming one or more coarse tuning circuits. For example, if only fast coarse tuning or only slow coarse tuning is used, counter 44 and decoder 50 may be considered as forming only one coarse tuning circuit. If both fast coarse tuning and slow coarse tuning is used, counter 44 and decoder 50 may be considered as forming a first coarse tuning circuit and a second coarse tuning circuit.

As illustrated, comparator 32 may compare a voltage indicative of the LED current (VCOM voltage) to a first threshold voltage (e.g., 1.6V), and comparator 40 may compare the voltage indicative of the LED current to a second threshold voltage (e.g., 1.2V). In this example, the coarse tuning circuit is configured to determine which capacitors of the plurality of capacitors C0-C32 are to be connected in parallel based on the comparison of comparator 32 and comparator 40. The values of 1.6V and 1.2V as the first threshold voltage and the second threshold voltage are provided for purposes of illustration only and should not be considered limiting.

In some examples, a second coarse tuning circuit may determine which capacitors of the plurality of capacitors C0-C32 are to be connected in parallel to adjust the amount of time the power transistor is turned on by a third step-size larger than the second step-size. For example, if VCOM voltage is greater than 1.8V or less than 1.2V, the adjustment to the on-duration of power transistor M0 may be 50% versus 10% if VCOM voltage is greater than 1.6V and less than 1.8V or less than 1.4V but greater than 1.2V. As above, the values of 1.8V and 1.2V are provided for illustration purposes and should not be considered limiting.

In some cases, when the second coarse tuning circuit determines which capacitors are to be connected in parallel, the first coarse tuning circuit does not determine which capacitors of the plurality of capacitors C0-C32 are to be connected in parallel. For example, if fast coarse tuning is applied to adjust the on-duration by 50%, then slow coarse tuning may not be applied until after the fast coarse tuning or may not be applied at all if fine tuning is able to adjust the LED current to the target current level.

In this manner, the fine tuning circuit and the coarse tuning circuit adjust the amount of time the power transistor is turned on to adjust an amount of the LED current that flows through the one or more LEDs to a target LED current level. For instance, LED driver 14, via the fine tuning circuit and the coarse tuning circuit, may be configured to adjust the amount of LED current flowing through the one or more LEDs to the target LED current level without sensing an input voltage of LED driver 14 or an output voltage across the one or more LEDs (e.g., across LEDs 0 and 1).

In some examples, to achieve the wide range for the on-duration (e.g., from 800 ns to 20 us with at least 10% step size), if only capacitors are used to set the on-duration for coarse tuning, the difference between the capacitor used to produce the smallest on-duration and that for the largest on-duration may be about 25 times. Also, the capacitances of the capacitors in the middle should be of different resolution to achieve the 10% adjustment step. For example, if the capacitor for 800 ns on-duration is 4 pico-Farad (pF), then the capacitor for 20 us may be approximately 100 pF, with capacitor range of 4.4 pF, 4.84 pF (+10%) . . . 125 pF. Again, these capacitor values may be for the coarse tuning. The variation of the charging current ICHARGE together with the fractional-n method is used for fine tuning.

To save on size of LED driver 14 while still maintaining wide range and adjustment step, it may be possible to utilize a combination of capacitors and D flip-flops to set the required on-duration. For example, for the smaller on-duration, the capacitors may range from 4 pF to 7.5 pF, in steps of 0.5 pF. For the larger on-duration, it may be possible to count multiple number (1×, 2× . . . 32×) of the ramp while varying the capacitance value too.

For instance, in some examples, the on-duration can be determined by measuring the time it takes to charge one or more capacitors with a current to reach a threshold voltage from an initial voltage of 0V. Accordingly, the rate at which the voltage on the one or more capacitors ramps up is indicative of the on-duration of the power transistor. If the capacitor is larger, then the time taken for the voltage on the one or more capacitors to ramp up to threshold voltage is longer.

If an even longer on-duration is needed (e.g., 2× the previous on-duration), LED driver 14 may allow the voltage on the one or more capacitors to ramp up to threshold voltage, then short the voltage back to zero, and then ramp up the one or more capacitors to the threshold voltage again. In this case, the on-duration is an addition of two times the ramp up of the one or more capacitors to the voltage threshold. In some examples, by counting the number of times the voltage on the one or more capacitors ramps up to the threshold voltage using a counter of D flip-flops, LED driver 14 may increase the on-duration that is a multiple of the time it takes the voltage on the one or more capacitors to reach the threshold voltage.

In this way, the techniques described in this disclosure provide for an LED driver that is able to control the amount of time power transistor M0 through which the LED current flows (i.e., on-duration of power transistor M0) over a wide enough range to cover universal input and wide output voltage range. Also, in the techniques described in this disclosure, if there is large deviation in the amount of current flowing through the one or more LEDs from the target current level, LED driver 14 may be configured to adjust the on-duration of the power transistor M0 in large step-sizes so that amount of current flowing through the one or more LEDs quickly converges back to approximately the target current level. If there is small deviation in the amount of current flowing through the one or more LEDs from the target current level, LED driver 14 may be configured to adjust the on-duration of the power transistor M0 in small step-sizes so as to minimize flicker. In some examples, LED driver 14 may be configured to adjust the on-duration of the power transistor M0 without sensing the input or output voltage.

The techniques described in this disclosure may provide one or more of the following advantages. For instance LED driver 14 may provide for universal input, where regardless of the whether the line voltage is high or low or the amplitude of the line voltage, the LED current remains the same (i.e., converges back to the target current level). Similarly, over a wider output range, the LED current remains the same. With coarse tuning, on-duration tuning circuit 22, via constant on-time circuit 30, will reach the on-duration relatively quickly, meaning that the LED current will reach the target current level relatively quickly. Such quick correction of the LED current may be particularly useful in the case when the input voltage suddenly changes from high line to low line or vice-versa intermittently after startup. Also, the techniques described in this disclosure may not affect the chip size of LED driver 14. For instance, only some additional comparators and some D flip-flops may be needed to implement the techniques described in this disclosure, and such components may not require a lot of additional area.

Simulation has been performed to determine the efficacy of the techniques described in this disclosure. In the following examples, the target LED current level was 0.47 A.

In one simulation, the input voltage was a DC voltage set high and the output voltage was approximately 28V. In this case, simulation showed that the LED current can be regulated to 0.47 A. In another simulation, the input voltage was AC voltage set low and the output voltage was approximately 28V. In this case, simulation showed that the LED current can be regulated to 0.475 A.

In another simulation, for the first 0.8 seconds, the input voltage was low and AC voltage and the output voltage was approximately 28V. Simulation showed that the LED current can be regulated to 0.475 A. Then from 0.8 seconds to 1.6 seconds, the input voltage was high and DC voltage and the output voltage was approximately 28V. Simulation showed that the LED current can be regulated to 0.474 A. Then from 1.6 seconds to 2.4 seconds, the input voltage was low and AC voltage and the output voltage was approximately 28V. Simulation showed that the LED current can be regulated to 0.477 A. In this simulation, even if the input voltage is changed from AC to DC and back to AC, the LED current can still be regulated to the target current level.

In another simulation, the input voltage was high and AC voltage and the output voltage was approximately 65V. Simulation showed that the LED current can be regulated to 0.473 A. The above simulation results illustrated that no matter whether the input voltage is AC or DC, no matter whether the input voltage is high or low, no matter whether the input voltage will change or not, and no matter whether the output voltage is high or low, the techniques cause the LED current to reach the target current level.

Figure 4:
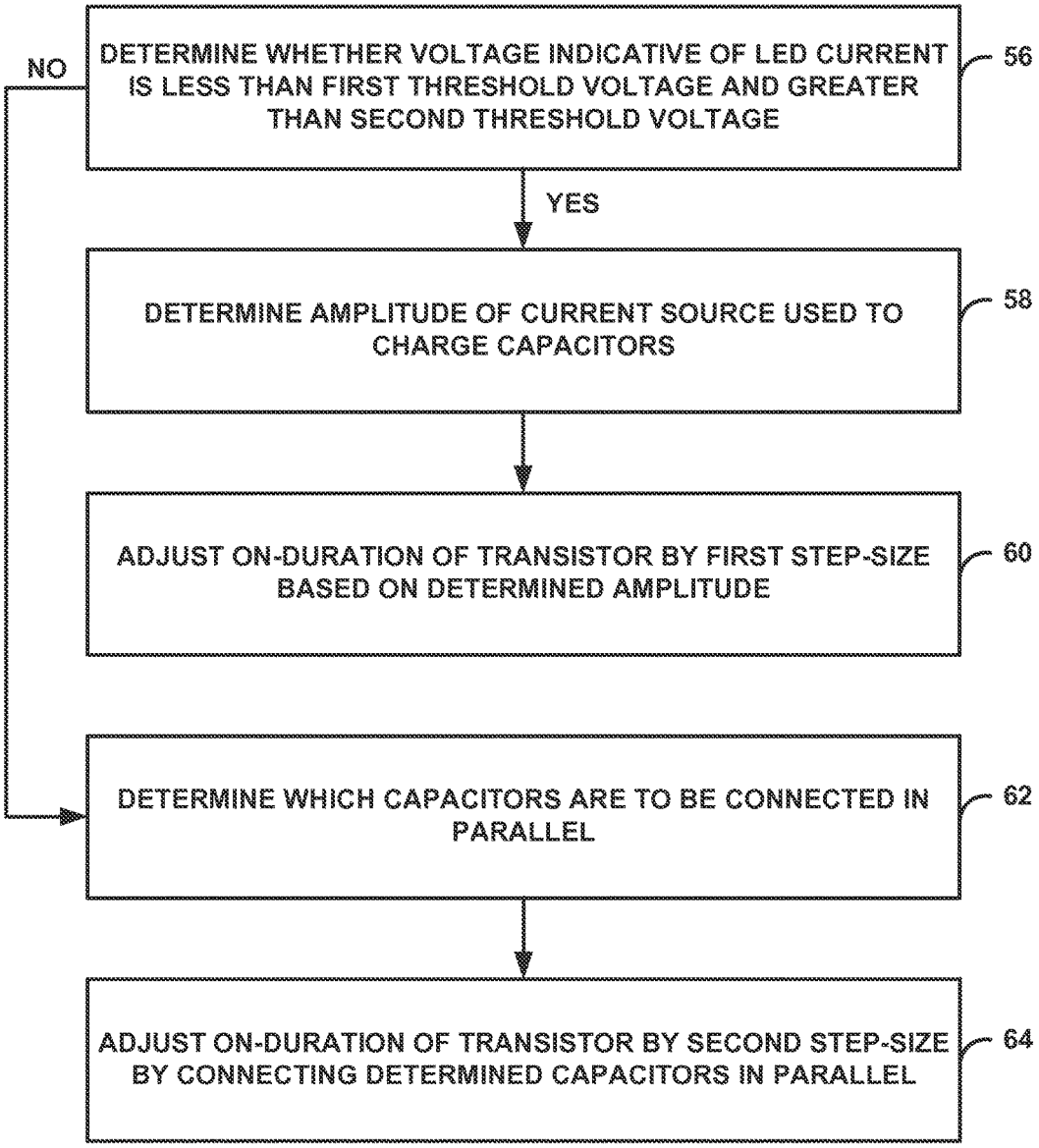
FIG. 4 is a flowchart illustrating an example technique in accordance with the techniques described in this disclosure.

FIG. 4 is a flowchart illustrating an example technique in accordance with the techniques described in this disclosure. In general, FIG. 4 illustrates an example technique for adjusting an amount of time a power transistor is turned on (e.g., on-duration of power transistor M0) which cause an amount of LED current flowing through one or more LEDs and the power transistor to adjust to a target LED current level.

LED driver 14 may determine whether a voltage indicative of an LED current flowing through one or more LEDs (e.g., VCOM voltage) is less than a first threshold voltage and greater than a second threshold voltage (56). For example, as illustrated in FIG. 3, comparator 32 compares the VCOM voltage to a threshold voltage of 1.6V, and comparator 40 compares the VCOM voltage to a threshold voltage of 1.4V. In this example, the first threshold voltage is 1.6V and the second threshold voltage is 1.4V. For instance, comparators 32 and 40 may indicate whether the VCOM voltage is less than 1.6V and greater than 1.4V.

In response to determining that the VCOM voltage is less than the first threshold voltage and greater than the second threshold voltage (YES of 56), LED driver 14 may determine an amplitude of a current source used to charge one or more of a plurality of capacitors (58). For instance, in this case, the VCOM voltage is less than 1.6V and greater than 1.4V. Also, comparator 34 may also indicate whether the VCOM voltage is greater than or less than 1.5V. In this case, counter 42 and DAC 48, which together form part of a fine tuning circuit, may determine an amplitude of the ICHARGE current source to charge one or more of capacitors C0-C32.

LED driver 14 may adjust an amount of time the power transistor is turned on (e.g., on-duration of the power transistor M0) by a first step-size (e.g., 0.1%) by charging the one or more of the plurality of capacitors based on the determined amplitude (60). In some examples, LED driver 14 may implement the fractional-n method to adjust on-duration of transistor M0 by the first step-size. For instance, LED driver 14 may cause the ICHARGE current source to output current at the determined amplitude for one switching pulse within a unit of switching pulses to adjust the amount of time the power transistor M0 is turned on by a larger step-size (e.g., 3.2% which is larger than 0.1%). LED driver 14 may cause the ICHARGE current source to output current at a previous amplitude for the remaining switching pulses in the unit.

As described above, a switching pulse comprises one instance of the LED current turning on and off, and there are one or more units of switching pulses in a half cycle of an AC input voltage or a set period of a DC input voltage. In this example, the ICHARGE current source outputs current at amplitude as determined by fractional unit 54 for one switching pulse within the unit of switching pulses and outputs current at the previous amplitude for the remaining switching pulses, which causes an effective adjustment to the amount of time the power transistor M0 is turned on (e.g., on-duration of power transistor M0) by the first step-size (e.g., 0.1%) for the half cycle of the AC input voltage or the set period of the DC input voltage.

In response to determining that the VCOM voltage is greater than the first threshold voltage or less than the second threshold voltage (NO of 56), LED driver 14 may determine which capacitors of the plurality of capacitors are to be connected in parallel (62). LED driver 14 may adjust the amount of time the power transistor is turned on (e.g., the on-duration of power transistor M0) by a second, larger step-size (e.g., at least 10%) by connecting the determined capacitors in parallel (64). In some examples, LED driver 14 may also implement fine tuning techniques to minimize flicker and converge the LED current more closely to the target LED current level.

For example, when the VCOM voltage is greater than 1.6V or less than 1.4V, or greater than 1.8V or less than 1.2V, counter 44, which is part of the coarse tuning circuit, increments or decrements the count accordingly. Decoder 50 utilizes a look-up table to determine which capacitors of capacitors C0-C32 should be connected in parallel to adjust the on-duration of power transistor M0 by the second, larger step size (e.g., 10% if greater than 1.6V and less than 1.8V or less than 1.4V and greater than 1.2V or 50% if greater than 1.8V or less than 1.2V). Decoder 50 may connect the determined capacitors in parallel by closing respective switches connected to respective capacitors.

Various examples of techniques and circuits have been described. These and other examples are within the scope of the following claims.

What is claimed is:

1. A light emitting diode (LED) driver comprising:

a plurality of capacitors;

a fine tuning circuit configured to determine an amplitude of a current source used to charge one or more of the plurality of capacitors to adjust an amount of time a power transistor is turned on by a first step-size;

a coarse tuning circuit configured to determine which capacitors of the plurality of capacitors are to be connected in parallel to adjust the amount of time the power transistor is turned on by a second step-size, wherein the second step-size is larger than the first step-size, wherein an LED current flows through one or more LEDs and into the LED driver via the power transistor, and wherein the fine tuning circuit and the coarse tuning circuit adjust the amount of time the power transistor is turned on to adjust an amount of the LED current that flows through the one or more LEDs to a target LED current level;

a comparator configured to compare a voltage indicative of the amount of LED current flowing through the one or more LEDs to a threshold voltage, wherein the fine tuning circuit is configured to determine the amplitude of the current source based on the comparison.

2. The LED driver of claim 1, wherein the fine tuning circuit is configured to cause the current source to:

output current at the amplitude determined by the fine tuning circuit for one switching pulse within a unit of switching pluses to adjust the amount of time the power transistor is turned on by a third step-size, wherein the third step-size is different than the first step-size and the second step-size; and output current at a previous amplitude for the remaining switching pulses in the unit, wherein a switching pulse comprises one instance of the LED current turning on and off, wherein there are one or more units of switching pulses in a half cycle of an AC input voltage or a set period of a DC input voltage, and wherein outputting current at the amplitude determined by the fine tuning circuit for one switching pulse within the unit of switching pulses and outputting current at the previous amplitude for the remaining switching pulses causes an effective adjustment to the amount of time the power transistor is turned on by the first step-size for the half cycle of the AC input voltage or the set period of the DC input voltage.

3. The LED driver of claim 1, wherein the comparator comprises a third comparator, the LED driver further comprising:

a first comparator configured to compare a voltage indicative of the amount of LED current flowing through the one or more LEDs to a first threshold voltage; and a second comparator configured to compare the voltage indicative of the amount of LED current flowing through the one or more LEDs to a second threshold voltage, wherein the second threshold voltage is different than the first threshold voltage, wherein the coarse tuning circuit is configured to determine which capacitors of the plurality of capacitors are to be connected in parallel based on the comparison of the first comparator and the second comparator.

4. The LED driver of claim 1, wherein the LED driver, via the fine tuning circuit and the coarse tuning circuit, is configured to adjust the amount of LED current flowing through the one or more LEDs to the target LED current level without sensing an input voltage of the LED driver or an output voltage across the one or more LEDs.

5. The LED driver of claim 1, wherein the first step-size comprises an adjustment of 0.1% to the amount of time the power transistor is turned on, and wherein the second step-size comprises an adjustment of at least 10% to the amount of time the power transistor is turned on.

6. The LED driver of claim 1, wherein the coarse tuning circuit is configured to adjust the amount of time the transistor is turned on from a range of approximately 800 nanoseconds to 20 microseconds.

7. The LED driver of claim 6, wherein the fine tuning circuit is configured to adjust the amount of time the transistor is turned on from a range approximately equal to ±25% of the range of the coarse tuning circuit.

8. The LED driver of claim 1, wherein the fine tuning circuit comprises a counter and a fractional unit, wherein the counter indicates whether the adjustment to the amount of time the power transistor is turned on is needed based on the comparison by the comparator, and wherein the fractional unit determines a modification to the amplitude of the current source used to charge one or more of the plurality of capacitors based on the counter value.

9. The LED driver of claim 1, wherein the coarse tuning circuit comprises a counter and a decoder, wherein the counter indicates whether the adjustment to the amount of time the power transistors is turned on is needed, and wherein the decoder determines which capacitors of the plurality of capacitors are to be connected in parallel based on the counter value.

10. A system for illuminating one or more light emitting diodes (LED) comprising:

one or more LEDs;

a power transistor that receives an LED current flowing through the one or more LEDs; and an LED driver that receives the LED current from the power transistor and is configured to:

adjust an amount of time the power transistor is turned on by a first step-size by determining an amplitude of a current source to charge one or more of a plurality of capacitors; and adjust the amount of time the power transistor is turned on by a second step-size by determining which capacitors of the plurality of capacitors are to be connected in parallel, wherein the second step-size is larger than the first step-size, wherein the LED driver adjusts the amount of time the power transistor is turned on to adjust an amount of the LED current that flows through the one or more LEDs to a target LED current level, wherein the LED driver further comprises a comparator configured to compare a voltage indicative of the amount of LED current flowing through the one or more LEDs to a threshold voltage, and wherein the LED driver is configured to determine the amplitude of the current source based on the comparison.

11. The system of claim 10, wherein LED driver is configured to cause the current source to:

output current at the determined amplitude for one switching pulse within a unit of switching pluses to adjust the amount of time the power transistor is turned on by a third step-size, wherein the third step-size is different than the first step-size and the second step-size; and output current at a previous amplitude for the remaining switching pulses in the unit, wherein a switching pulse comprises one instance of the LED current turning on and off, wherein there are one or more units of switching pulses in a half cycle of an AC input voltage or a set period of a DC input voltage, and wherein outputting current at the determined amplitude for one switching pulse within the unit of switching pulses and outputting current at the previous amplitude for the remaining switching pulses causes an effective adjustment to the amount of time the power transistor is turned on by the first step-size for the half cycle of the AC input voltage or the set period of the DC input voltage.

12. The system of claim 10, wherein the comparator comprises a third comparator, and wherein the LED driver comprises:

a first comparator configured to compare a voltage indicative of the amount of LED current flowing through the one or more LEDs to a first threshold voltage; and a second comparator configured to compare the voltage indicative of the amount of LED current flowing through the one or more LEDs to a second threshold voltage, wherein the second threshold voltage is different than the first voltage, wherein the LED driver is configured to determine which capacitors of the plurality of capacitors are to be connected in parallel based on the comparison of the first comparator and the second comparator.

13. The system of claim 10, wherein the LED driver is configured to adjust the amount of LED current flowing through the one or more LEDs to the target LED current level without sensing an input voltage of the LED driver or an output voltage across the one or more LEDs.

14. The system of claim 10, wherein the first step-size comprises an adjustment of 0.1% to the amount of time the power transistor is turned on, and wherein the second step-size comprises an adjustment of at least 10% to the amount of time the power transistor is turned on.

15. The system of claim 10, wherein the LED driver is configured to adjust the amount of time the power transistor is turned on by the second step-size from a range of approximately 800 nanoseconds to 20 microseconds.

16. The system of claim 15, wherein the LED driver is configured to adjust the amount of time the power transistor is turned on by the first step-size from a range approximately equal to ±25% of the range of the adjustment to the amount of time the transistor is turned on by the second step-size.

17. A method for illuminating one or more light emitting diodes (LEDs) comprising:

comparing a voltage indicative of an amount of LED current flowing through one or more LEDs to a first threshold voltage and a second threshold voltage to determine whether the voltage indicative of the amount of LED current flowing through the one or more LEDs is less than the first threshold voltage and greater than the second threshold voltage, wherein the LED current flows through a power transistor;

in response to determining that the voltage is less than the first threshold voltage and greater than the second threshold voltage:

determining an amplitude of a current source based on the comparison to charge one or more of a plurality of capacitors; and adjusting an amount of time the power transistor is turned on by a first step-size by charging the one or more of the plurality of capacitors based on the determined amplitude;

in response to determining that the voltage is greater than the first threshold voltage or less than the second threshold voltage:

determining which capacitors of the plurality of capacitors are to be connected in parallel; and adjusting the amount of time the power transistor is turned on by a second step-size by connecting the determined capacitors in parallel, wherein the second step-size is larger than the first step-size, wherein adjusting the amount of time the power transistor is turned on causes the amount of the LED current to adjust to a target LED current level.

* * * * *